United States Patent [19]

Caubet

[11] 3,996,400

[45] Dec. 7, 1976

[54] METHOD FOR SURFACE COATING FERROUS ALLOY PARTS

[75] Inventor: Jacques-Jean Caubet, Andrezieux-Boutheon, France

[73] Assignee: Centre Stephanois de Recherches Mecaniques Hydromecanique et Frottement, Andrezieux-Boutheon, France

[22] Filed: Dec. 12, 1974

[21] Appl. No.: 532,105

[30] Foreign Application Priority Data

Apr. 25, 1973 France ..... 73.15787

[52] U.S. Cl. ..... 427/253

[51] Int. Cl.[2] ..... C23C 13/02

[58] Field of Search ..... 427/253; 29/196.4, 196.1, 29/196.2; 148/6.35

[56] References Cited

UNITED STATES PATENTS

| | | | |
|---|---|---|---|
| 2,689,807 | 9/1954 | Kempe et al. | 427/253 |
| 2,815,299 | 12/1957 | Raymond | 427/253 |
| 3,617,359 | 11/1971 | Wakefield | 427/253 |
| 3,625,751 | 12/1971 | Walles | 427/248 X |

FOREIGN PATENTS OR APPLICATIONS

| | | | |
|---|---|---|---|
| 816,656 | 7/1969 | Canada | 427/253 |
| 468,796 | 10/1950 | Canada | 427/253 |
| 1,527,560 | 5/1968 | France | 427/253 |

OTHER PUBLICATIONS

Powell et al., Vapor Deposition, pp. 316–319 (1966).

Doo et al., "Process for Molybdenum Vapor Deposition," IBM Tech. Discl. Bulletin, vol. 13, No. 2, July 1970.

*Primary Examiner*—Harry J. Gwinnell

*Attorney, Agent, or Firm*—Sughrue, Rothwell, Mion, Zinn & Macpeak

[57] ABSTRACT

Mechanical parts of ferrous alloys are provided with a coating consisting essentially of $FeSn_2$, FeSn and $FeSnC_x$ with $x$ ranging from 0.7–1.3 by holding the part to be treated in an oven at a temperature ranging from 400° to 700° C while the gaseous atmosphere inside the oven is comprised of a mixture of a vapor of a tin halide and a reducing gas.

1 Claim, 4 Drawing Figures

1: XC35 (STRUCTURAL STEEL CONTAINING 0.35% CARBON)
2: XC35 COATED WITH "THE LAYER"

METHOD FOR SURFACE COATING FERROUS ALLOY PARTS

CROSS-REFERENCE TO RELATED APPLICATION

The present application is a Division of application Ser. No. 463,923, filed Apr. 24, 1974, now U.S. Pat. No. 3,890,686, granted June 24, 1975.

BACKGROUND OF THE INVENTION

Surface treatments are known for parts made of ferrous alloys, in order to increase the resistance of said parts to seizing and surface wearing. Other treatments are known, which improve the resistance of such parts to corrosion. But if, in addition, the variations in the total resistance of said parts to fatigue and to brittleness, or the variations in the adsorption of the oil film on the surface of the parts, as a result of any such known treatment, are taken into consideration, one finds that at the present time there exists no treatment enabling at least five out of the six above-mentioned mechanical characteristics to be improved, the sixth one, at the worst, remaining unchanged.

The object of the present invention is to reconcile the various requirements. It relates to mechanical parts made of ferrous alloys which are treated in a manner such that, according to the invention, said parts are coated with a novel layer, having surprising properties, and called hereinafter "the layer". A part coated with the layer increases substantially five of its mechanical characteristics mentioned hereinabove, that is, its resistance to seizing, to wear, to corrosion, and to shocks, as well as its ability to adsorb the oil film highly, while its sixth characteristic, that is, its overall resistance to fatigue, is not altered.

The features the layer should jointly have in order to be in accordance with the invention are as follows:

1. the thickness thereof ranges from 5 to 80 microns;

2. it includes necessarily at least the FeSn, $FeSn_2$ and $FeSnC_x$ phases ($x$ being a number ranging from 0.7 to 1.3). If the whole layer is analyzed, the proportion of each of said three phases should necessarily be included within the following ranges:

$FeSn_2$ from 5 to 30% by volume

FeSn from 60 to 90% by volume $FeSnC_x$ from 0 to 10% by volume.

Figure 1:
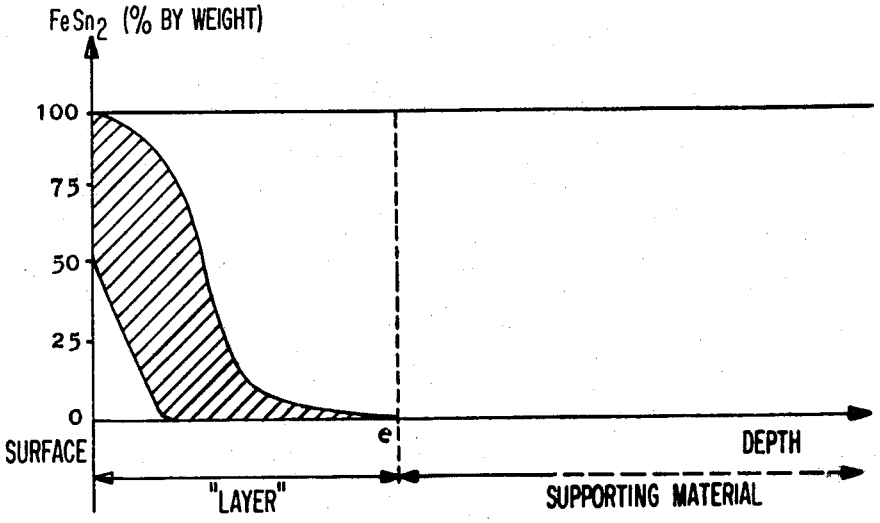
FIGS. 1, 2 and 3 are graphs showing the concentration gradients of $FeSn_2$, FeSn and $FeSnC_x$.
Figure 2:
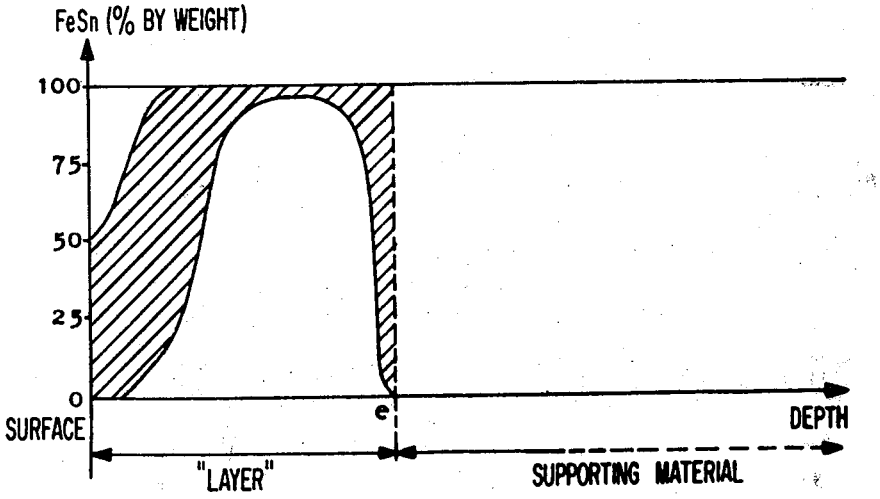
Figure 3:
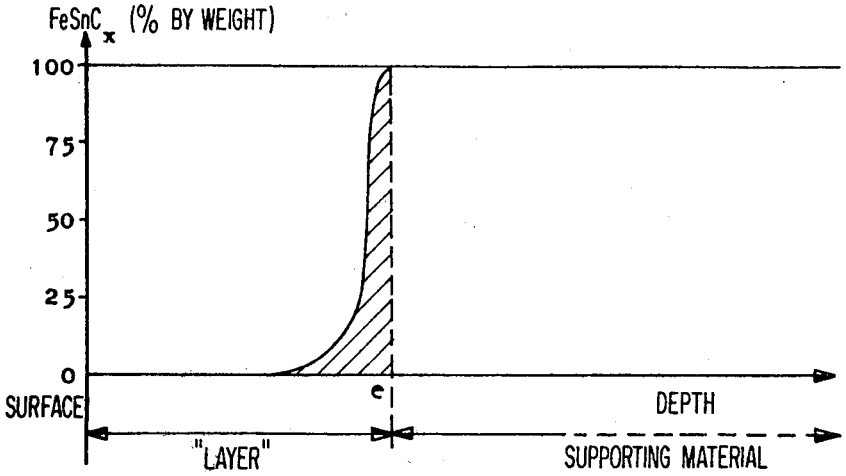

3. In addition to these proportions resulting from an analysis throughout the thickness of the layer, the latter, when coating mechanical parts made of ferrous alloys in accordance with the invention should show concentration gradients of each of said three phases, which gradients should comply, from the outside to the inside, with the accurate rules graphically shown in the FIGS. 1-3 of the drawings. In other words:

- the $FeSn_2$ content should be within the hatched area of FIG. 1;
- the FeSn content should be within the hatched area of FIG. 2;
- the $FeSnC_x$ content should be within the hatched area of FIG. 3.

4. The layer follows also, from the outside towards the inside, very accurate hardness laws, which make it conformable with the so-called "three layer" scientific rule which governs the design of surfaces having a good resistance to seizing and deformation. One may consult thereabout the work entitled "Surface treatments against wear: description and industrial applications" by "Centre Stephanois de Recherches Mecaniques HYDROMECANIQUE ET FROTTEMENT" (Editor: Dunod, Paris, 1968).

The thickness of the layer will be indicated hereinafter by $c$, $c$ being a value pre-selected as a function of the parameters of the problem of mechanics set.

Said hardness laws are as follows: according to the Vickers standard and under a load of 15 g, the hardness at a depth of $e/5$ from the outside to the inside should range from 500 to 650 Vickers; then, it increases and goes through a maximum which lies at a depth ranging from $e/5$ to $e$, said maximum having to range from 600 to 900 Vickers.

Performances obtained with parts having ferrous alloy surfaces, and coated with the layer according to the invention, are given hereinafter.

1. Resistance to seizing -

The test for resistance to seizing was carried out on a HEF type "Tribometer" apparatus. This is a friction simulator which allows, with a ring and a small plate, to represent a cylindrical sliding contact over a plane. While the ring is rotating, the parallelepipedal plate describes a reciprocating translation motion, which allows keeping a constant generatrix contact for any length of time. Such a test, when carried out in water on a plate of structural steel containing 0.35% carbon, with a ring of hardened cement steel, results in immediate seizing. On the contrary, under the same conditions, with a plate of the same material coated with the layer according to the invention, the test was voluntarily stopped after 15 hours without any sign of seizing appearing.

2. Adsorption of the oil film -

Figure 4:
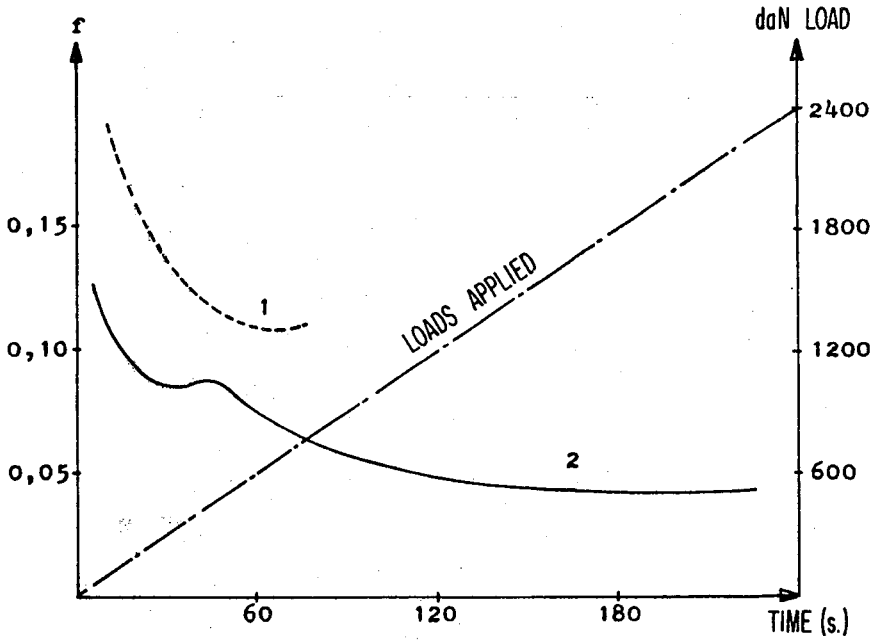
FIG. 4 is graph showing the influence of a layer on the adsorption of an oil film.

The test for adsorption of the oil film was carried out on a Faville Levally apparatus. In such a kind of test, the test tube, which has a diameter of 6 mm and a height of 40 mm, is rotatively driven between two jaws cut in V-shape with angles of 90°. The jaws and test tube assembly are immersed in oil. A load which increases linearly as a function of the time is applied on the jaws. FIG. 4 illustrates the influence of the layer on the adsorption of an oil film. It shows that the reference tube, made of structural steel containing 0.35% carbon, breaks its oil film at a load near to 600 daN, and seizes then immediately, while the test tube coated with the layer according to the invention may reach 2500 daN without the coefficient of friction exceeding a value of 0.05 at the end of the test, which proves that the oil film is sufficient for ensuring the friction under hydrodynamic conditions.

A micrographic examination of the tube shows that the supporting material has creeped and has been deeply "cold-hammered", while the micro-layer has been compacted.

3. Resistance to wear -

The tests for resistance to wear were carried out by means of the conventional so-called "pin on ring" device. The ring is given a rotary motion with a speed of 100 r.p.m., that is, a sliding speed of 0.3 m/s; The load applied on the pin is 10 N.

Under such conditions, with a pin made of steel containing 1% carbon and 1.5% chromium, the wearing speed of a reference disk made of structural steel containing 0.35% carbon is 8 mg/hour, while the wearing speed of a disk made of the same steel as the reference disk, but coated with the layer according to the invention, is only 2 mg/hour.

4. Resistance to fatigue -

The results of tests made with rotative deflection indicate that a part having a surface of ferrous alloy coated with the layer according to the invention has a total resistance to fatigue which varies by about 1%: the limit of fatigue of a reference tube made of structural steel containing 0.48% carbon is 40.2 kg/mm², while that of a tube made of the same material and coated with the layer according to the invention is 40.6 kg/mm². Such a variation is lower than the accuracy of the measurement, and shows therefore that the layer according to the invention has no adverse influence on the resistance of the treated parts to fatigue.

5. The tests for resiliency (resistance to shocks) carries out with a Charpy pendulum-tap indicate a marked reduction of the brittleness of the test tubes treated: for instance, on carbon structural steel containing 0.48% carbon, the resiliency passes from 2.9 to 3.7 daJ/cm² for tubes respectively uncoated and coated with the layer according to the invention, while on carbon structural steel containing 0.35% carbon the resiliency passes from 5.73 to 7.5 daJ/cm².

6. The tests for resistance to corrosion show that parts coated with the layer according to the invention behave quite well in an atmospheric environment and in a salt-containing environment, as compared with test tubes uncoated with the layer. For instance, after a 500 hour exposure to salt-containing fog, the characteristics of resistance to corrosion of the layer are such that the weight losses registered are substantially the same as those for a stainless steel, that is, about 0.3 mg/cm².

It is obvious that any method allowing obtaining the layer described hereinabove makes part of the present invention, in particular methods such as cementations in gaseous phase by the metals, or the electrolytic depositions followed by a baking operation intended to diffuse the metal deposited on the substrate.

According to the present invention mechanical parts of ferrous alloys are provided with a coating consisting essentially of $FeSn_2$, FeSn and $FeSnC_x$ with x ranging from 0.7–1.3 by holding the part to be treated in an oven at a temperature ranging from 400° C to 700° C while the gaseous atmosphere inside the oven is comprised of a mixture of a vapor of a tin halide and a reducing gas.

Non-limiting examples are given hereinafter, which describe the method for obtaining the layer according to the invention.

EXAMPLE 1

The part to be treated is immersed in a cement constituted by 5% of tin fluoride, $SnF_2$, and 95% of an inert substance such as magnesia; the part + cement assembly is raised to a temperature of 600° C. A reducing atmosphere is maintained during the whole duration of the treatment by a flushing with hydrogen. After one hour of treatment, the part is coated with a diffusion layer 50 micron thick, which is in accordance with the layer described in the present invention.

EXAMPLE 2

The part to be treated is raised to the temperature of 570° C in an oven, in the presence of tin chloride vapours, $SnCl_2$, such vapours being produced by heating tin chloride to the temperature of 500° C in a secondary oven, and then introduced into the main oven by a stream of hydrogenated nitrogen. After 1½ hour of treatment, the part is coated with a diffusion layer 50 micron thick, corresponding to the layer described in the present invention.

EXAMPLE 3

An electrolytic deposit of tin, 10 micron thick, is effected on the part to be treated, which is then subjected to the following heat treatment:

from 0 to 200° C within 13 minutes,
from 200 to 280° C within 7 hours,
from 290 to 570° C within 2 hours,
and then for 2 hours at 570° C.

A layer 25 micron thick is thus obtained on the surface of the part, said layer being in accordance with the layer described in the present invention.

I claim:

1. A method for coating a ferrous alloy member with a layer consisting essentially of $FeSn_2$, FeSn and $FeSnC_x$ phases where x ranges from 0.7 to 1.3 according to the following proportions:

$FeSn_2$ ranging from 5–30% by volume
FeSn ranging from 60–95% by volume
$FeSnC_x$ ranging from 0–10% by volume
the distribution of said three phases within the layer being in accordance with the diagrams of FIGS. 1, 2 and 3, respectively,
comprising the steps of placing the ferrous alloy member in an oven, maintaining the temperature range in said oven from 400° C to 700° C and providing a gaseous atmosphere inside said oven which is comprised of a mixture of the vapor of a tin halide and a reducing gas.

* * * * *